US005851129A

United States Patent [19]

Matsunaga et al.

[11] Patent Number: 5,851,129

[45] Date of Patent: Dec. 22, 1998

[54] BATTERY TERMINAL

[75] Inventors: Hideki Matsunaga; Takao Hata; Nori Inoue, all of Yokkaichi, Japan

[73] Assignee: Sumitomo Wiring Systems, Ltd., Japan

[21] Appl. No.: 915,935

[22] Filed: Aug. 21, 1997

[30] Foreign Application Priority Data

Aug. 21, 1996 [JP] Japan ..... 8-220087

[51] Int. Cl.[6] ..... H01R 4/42

[52] U.S. Cl. ..... 439/764; 439/762

[58] Field of Search ..... 439/764, 767, 439/768, 762, 763, 765, 771

[56] References Cited

U.S. PATENT DOCUMENTS 5,087,214 2/1992 Dewar ..... 439/763
5,302,142 4/1994 Tabata ..... 439/762
5,302,143 4/1994 Inoue et al. ..... 439/762
5,492,780 2/1996 Okada ..... 439/121

FOREIGN PATENT DOCUMENTS 4-7567 2/1992 Japan .

*Primary Examiner*—Neil Abrams
*Assistant Examiner*—T. C. Patel
*Attorney, Agent, or Firm*—Banner & Witcoff, Ltd.

[57] ABSTRACT

A terminal main body 3 has a supporting member 2 that clamps the periphery of a battery post P, and a pair of clamp arms 7. Each arm 7 has two angled bolt through holes 6. When a bolt 4 is attached, the attachment axis L and the attachment axis M of the post P are inclined at an angle thus increasing access possibilities for a wrench 15.

8 Claims, 3 Drawing Sheets

BATTERY TERMINAL

TECHNICAL FIELD

The present invention relates to a battery terminal used for connecting electric wires to terminal posts of a battery provided on automobiles and the like.

BACKGROUND TO THE INVENTION

Conventional battery terminals include the one described in the Japanese Patent Publication 4-7567 (see FIGS. 6 and 7 of this specification). A battery terminal 30 comprises a tubular member 31 for engaging a terminal post P protruding from a battery B, a pair of arms 32 for closing the tubular member 31, and a bolt 33 and nut 34 between the arms 32. An electric wire connecting member 36 for connecting an electric wire terminal 35 is provided on the opposite side to the arms 32.

In this battery terminal 30, it is arranged so that the bolt 33 is diagonal, and it is thereby made easier to attach a wrench 40 to tighten the nut.

However, in the conventional battery terminal 30, the axis of the bolt 33 is unidirectional; that is, as shown in FIG. 7, only one direction, which extends from the upper right diagonal as illustrated. For this reason, it can be difficult for the tightening operation to be carried out depending on the type of battery B or on the location in the vehicle.

The present invention has been developed after taking the above problem into consideration, and aims to present a battery terminal wherein the attachment problem is solved.

SUMMARY OF THE INVENTION

According to the invention there is provided a battery terminal comprising a clamp for substantially encircling a battery post, and having protruding arms facing each other and adapted to be drawn together to tighten the clamp about the post, the clamp having an axis coincident in use with the axis of symmetry of said post, and further including a bridging screw between said arms and being operable to tighten or loosen the clamp, characterized in that the bridging screw acts at an acute angle to a plane perpendicular to said axis, said clamp being provided with two alternative locations for said screw, the locations being substantially symmetrical about said plane.

The provision of alternative locations for the bridging screw (for example a nut and bolt) ensures that the clamp can be tightened and loosened in confined spaces in the most efficient manner.

The arms may include individual holes to receive the screw, or each arm may have a slot to give an infinite variety of screw positions. The arms may have substantially flat bridging faces perpendicular to desired tightening directions: these may give the arms the appearance of an incomplete polygon.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENTS

A first embodiment of the present invention is explained hereinbelow, with reference to FIGS. 1 and 2.

Figure 1:
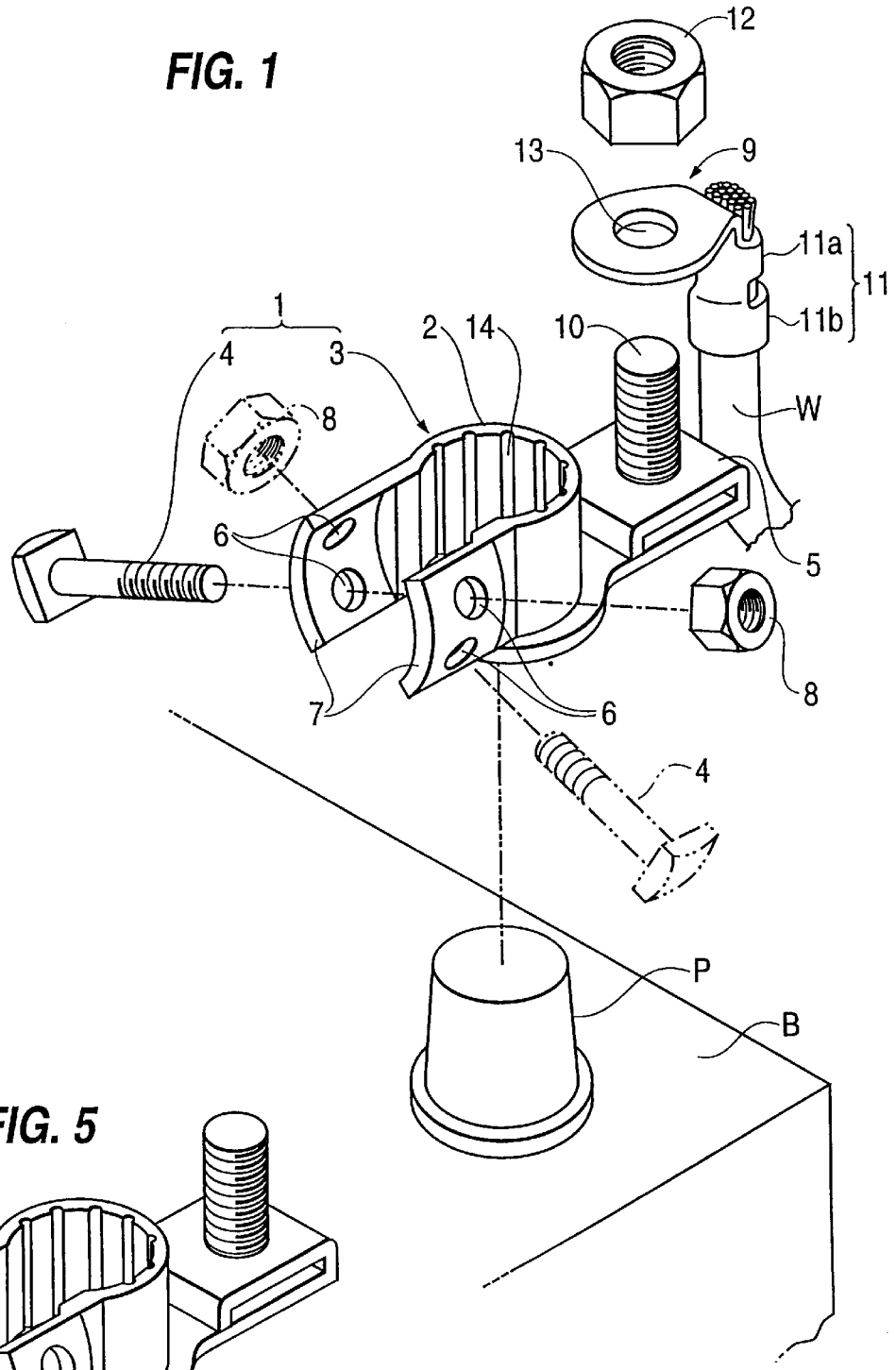
FIG. 1 is a diagonal view of a first embodiment showing a stage prior to the attachment of a battery terminal to a battery.
Figure 2:
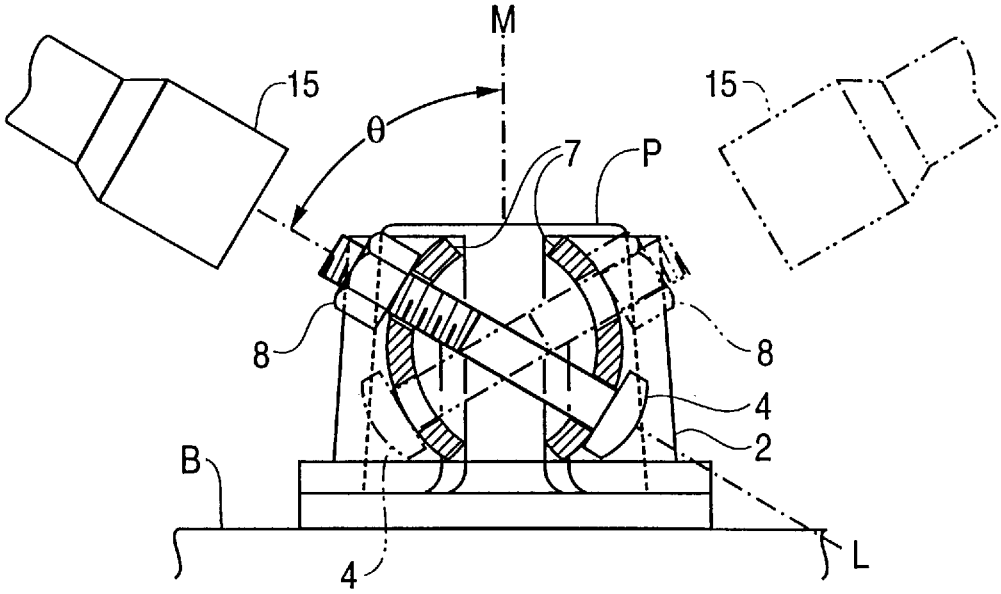
FIG. 2 is a front cross-sectional view of the first embodiment showing the state when a bolt is tightened.

FIG. 1 is a diagonal view showing a state prior to the attachment of a battery terminal 1 to a terminal post P.

The battery terminal 1 comprises a terminal main body 3, that is attached to a post P which protrudes from a battery B in a slightly tapering truncated cone shape; and a screwed connection comprising a nut 8 and bolt 4.

The terminal main body 3 is formed by bending a relatively thin electrically conducting metal strip, and has a supporting member 2 and an electric wire connecting member 5 that continues from the electrode supporting member 2 and connects with an electric wire terminal 9.

The supporting member 2 is formed in a tapering tubular shape and surrounds and supports the periphery of the post P. In the natural state, its inner diameter is slightly greater than the outer diameter of the post P. The inner face of the supporting member 2 has a plurality of supporting grooves 14 for preventing slippage, each being formed along the axial direction of the supporting member 2, and being provided in a circumferential direction so as to be mutually equidistant. The supporting member 2 is attached so as to engage the post P from above.

A pair of tightening arms 7 protrude from the supporting member 2 so as to face each other. These tightening arms 7 are formed so as to extend on the opposite side to the connecting member 5. The arms 7 are symmetrically arc-shaped, each having two bolt through holes 6 formed above and below. It is arranged so that the bolt 4 is passed through the angled through holes 6. The tightening arms 7 are tightened by means of the bolt 4 and the nut 8, and the post P and the battery terminal 1 are fixed by closing the supporting member 2 in this manner.

In other words, one of the two possible directions of insertion of the bolt 4 is chosen and the bolt 4 inserted. An attachment axis L of the bolt 4 is inclined at an angle θ of approximately 60° with respect to an attachment axis M of the post P.

Generally, in the case where any member has to be tightened by means of a nut and a bolt, the attachment direction of the member corresponds to the attachment direction of the bolt. That is, the force applying on the bolt and the tightening force on the member correspond to each other.

However, in the present invention, the direction of tightening (the direction perpendicular to the attachment axis M of the post) of the arms 7 and the attachment axis L of the bolt 4 do not correspond. For this reason, the tightening force on the post P is the product of the force applying on the bolt 4 and the cosine of the angle of inclination of the attachment axis L of the bolt 4 with respect to the tightening direction of the arms 7. In the present embodiment, the product of the force applying on the bolt 4 and cosine 30° gives the tightening force for the post P.

The electric wire connecting member 5 extends in a direction that is opposite to the arms 7. Its central portion has a connection bolt or stud 10 that passes through an electric wire terminal 9 which is crimped to an electric wire W. The anterior end of the terminal 9 is circular in shape, and its centre has an attachment hole 13 which allows the connection bolt 10 to pass through. Its posterior end has two barrels 11 that crimp the electric wire W, the anterior end thereof having a wire barrel 11*a* for crimping the core wire of the electric wire W, and the posterior end thereof having an insulation barrel 11*b* for crimping the covered portion of the electric wire W.

With the configuration as described above, the operation and effects of the first embodiment are explained hereinbelow.

First, after passing the connection bolt 10 through the attachment hole 13 of the wire terminal 9, the connection bolt 10 is tightened by means of a connection nut 12 and the electric wire terminal 9 is thus attached to the electric wire connecting member 5.

Next, after attaching the supporting member 2 of the terminal main body 3 to the post P, from among the two bolt through holes 6, the one that is appropriate to the operation is chosen and the bolt 4 passed therethrough. Although in FIG. 2 the lower right and upper left bolt through holes 6 have been selected, depending on the shape of the battery B and the circumstances of the attachment position, the other two bolt through holes 6 may equally be selected. The nut 8 is attached to the bolt 4 and when this is tightened using a torque wrench 15, the arms 7 being drawn together to fix the post P and the battery terminal 1.

In this manner, according to the present embodiment, if a bolt 4 is passed through corresponding bolt through holes 6 from one arm 7 to the other arm 7, the post P is tightly gripped.

Since the attachment axis L of the bolt 4 is inclined symmetrically to the left and right with respect to the attachment axis M of the post P, the tightening operation can be performed in the open space diagonally above the battery B. For this reason, even in a narrow space the operation can be performed with ease. Moreover, since one can select a tightening direction that is symmetrical with respect to the attachment axis M, it becomes possible to carry out the tightening from a direction that is the most appropriate with respect to the surrounding environment.

Figure 3:
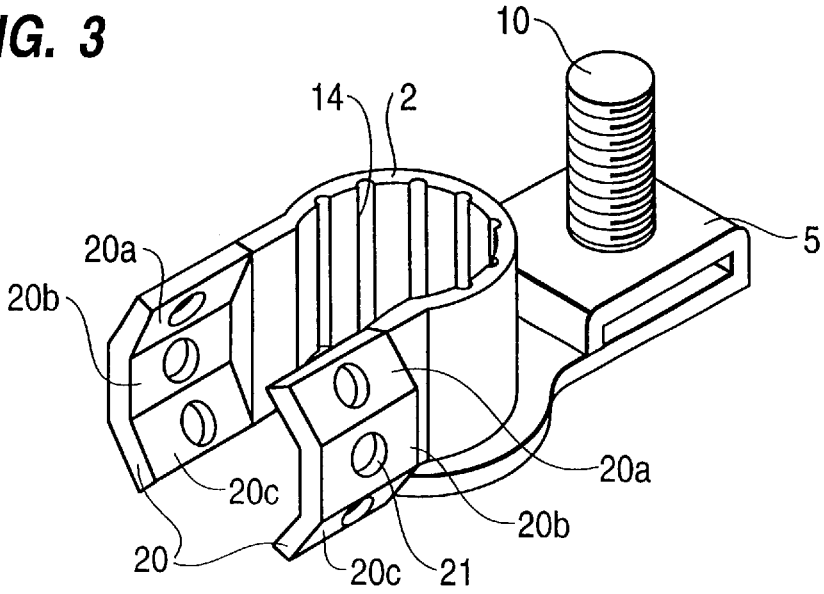
FIG. 3 is a diagonal view of a terminal main body of a second embodiment.
Figure 6:
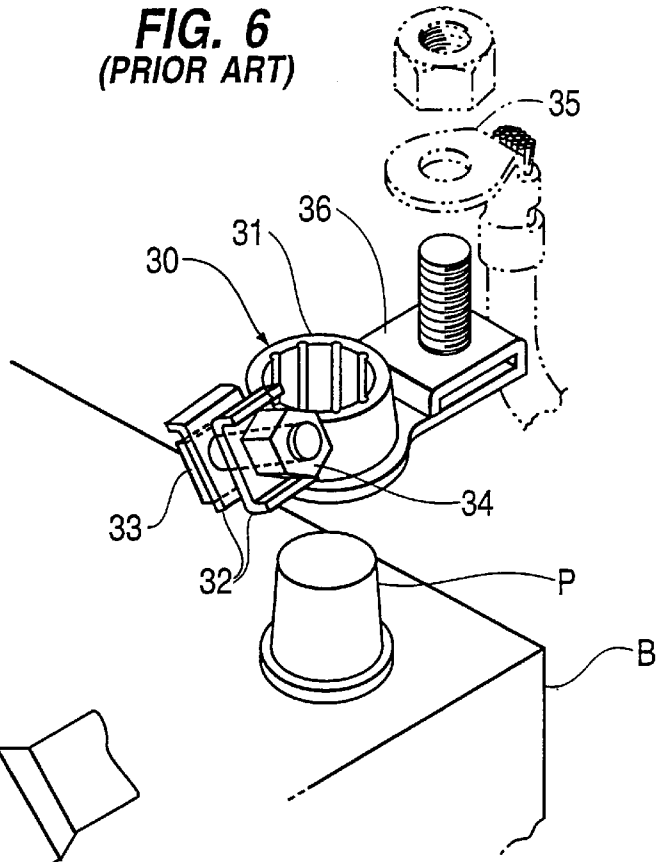
FIG. 6 (PRIOR ART)
FIG. 6 is a diagonal view showing a state prior to a prior art battery terminal being attached to a battery.
Figure 4:
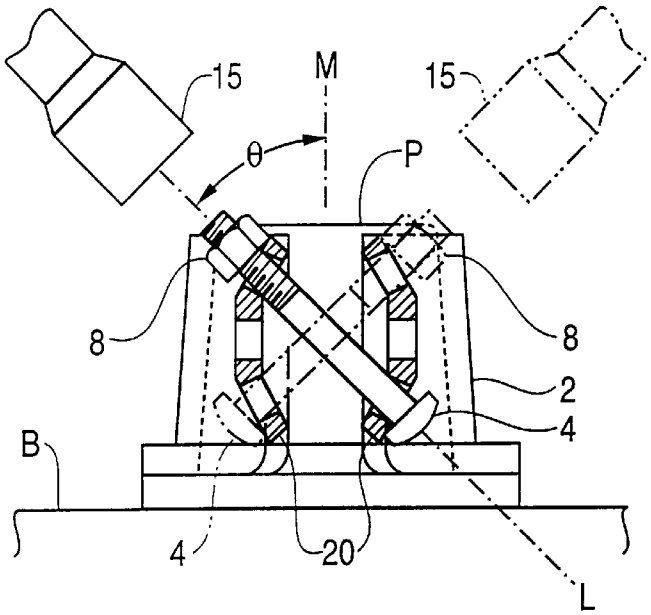
FIG. 4 is a front cross-sectional view showing the second embodiment in a state where a bolt is tightened.
Figure 7:
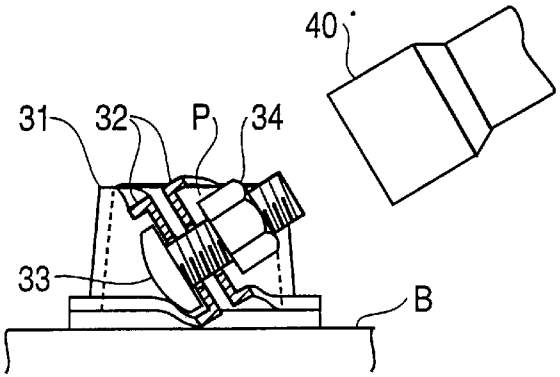
FIG. 7 (PRIOR ART)
FIG. 7 is a front cross-sectional view showing a state where a bolt of the prior art battery terminal is tightened.

A second embodiment of the present invention is explained with the aid of FIGS. 3 and 4. The difference between the present embodiment and the first embodiment lies only in the cross-sectional shape of arms 20. Since the configuration of the other parts is the same as in the first embodiment, the same numbers are accorded to parts having the same configuration as in the first embodiment, and an explanation thereof omitted.

The width dimension of the arms 20 protruding outwards from a supporting member 2 is divided into three equal parts by means of an upper face 20*a*, a central face 20*b*, and a lower face 20*c*, with the upper and lower faces 20*a* and 20*c* being bent inwards. The total of six faces have bolt through holes 21 which allow a bolt 4 to be passed through. One of the following combinations of facing faces parallel to each other is chosen: the lower right face 20*c* and the upper left face 20*a*, or the upper right face 20*a* and the lower left face 20*c*, or the centre right face 20*b* and the centre left face 20*b*. In FIG. 4, the bolt 4 is passed through the bolt through holes 21 of the lower right face 20*c* and the upper left face 20*a*. At this juncture, the inclination 8 of the attachment axis L of the bolt 4 with respect to the attachment axis M of the electrode P is approximately 45°. For the remaining two combinations, the inclinations θ of the attachment axis L of the bolt 4 with respect to the attachment axis M of the post P are respectively 90° and approximately 45°.

In the case of this configuration as well, the same operation and effects are achieved.

The present invention is not limited to the embodiments described above. For example, the possibilities described below also lie within the technical range of the present invention.

Figure 5:
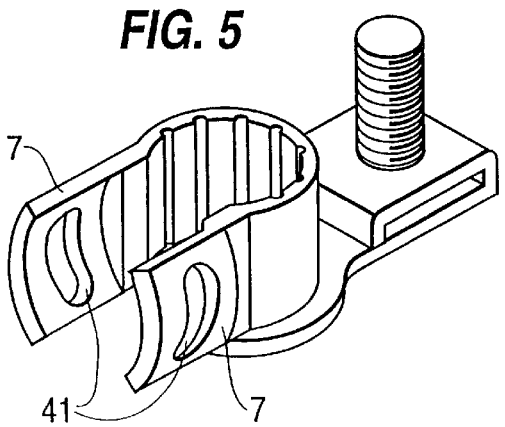
FIG. 5 is a diagonal view of a third embodiment of the invention.

(1) The bolt through hole provided in the arms can also be made in the form of a slot 41 as illustrated in FIG. 5. If the configuration is as described, the direction of the attachment axis of the bolt can be selected freely and the tightening operation performed. For this reason, the operating environment improves further.

(2) In the vicinity of the bolt through hole, a protrusion can engage the head portion of the bolt on the nut, these protrusions serving as movement stoppers during the tightening of the bolt and the nut.

We claim:

1. A battery terminal comprising a clamp for substantially encircling a battery post, the clamp having protruding arms facing each other and adapted to be drawn together to tighten the clamp about the post, the clamp having an axis coincident in use with the axis of symmetry of said post, and further including a bridging screw between said arms, said screw being operable to tighten or loosen the clamp, wherein the bridging screw acts at an acute angle to a plane perpendicular in all directions to said axis, said clamp being provided with at least two alternative orientations for said screw relative to said arms, and the orientations being substantially symmetrical about said plane, whereby the screw can be oriented upwardly on either side of the clamp.

2. A terminal according to claim 1 wherein said arms each have a plurality of bridging faces, each face being substantially perpendicular to a respective bridging direction of said screw.

3. A terminal according to claim 2 wherein said arms provide a further location for said screw to act in said plane.

4. A terminal according to claim 3 wherein said arms have the appearance of an incomplete polygon in section.

5. A terminal according to claim 1 wherein said arms are arcuate in cross-section.

6. A terminal according to claim 1 wherein said locations are defined by a slot of each of said arms.

7. A terminal according to claim 1 wherein said locations are individually defined by apertures of said arms.

8. A terminal according to claim 1 wherein a wire connecting member is provided on said clamp opposite to said arms.

* * * * *